US011519049B2

(12) United States Patent
Sun et al.

(10) Patent No.: US 11,519,049 B2
(45) Date of Patent: Dec. 6, 2022

(54) LOW TEMPERATURE RESISTANT OIL CASING HAVING HIGH STRENGTH AND HIGH TOUGHNESS, AND MANUFACTURING METHOD THEREOF

(71) Applicant: BAOSHAN IRON & STEEL CO., LTD., Shanghai (CN)

(72) Inventors: Wen Sun, Shanghai (CN); Zhonghua Zhang, Shanghai (CN); Xiaoming Dong, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 160 days.

(21) Appl. No.: 16/982,181

(22) PCT Filed: Mar. 14, 2019

(86) PCT No.: PCT/CN2019/078163
§ 371 (c)(1),
(2) Date: Sep. 18, 2020

(87) PCT Pub. No.: WO2019/179354
PCT Pub. Date: Sep. 26, 2019

(65) Prior Publication Data

US 2021/0025020 A1 Jan. 28, 2021

(30) Foreign Application Priority Data

Mar. 21, 2018 (CN) ..... 201810234656.8

(51) Int. Cl.

| | |
|---|---|
| ***C21D 9/08*** | (2006.01) |
| ***C21D 8/10*** | (2006.01) |
| ***C21D 6/00*** | (2006.01) |
| ***C22C 38/48*** | (2006.01) |
| ***C22C 38/46*** | (2006.01) |
| ***C22C 38/44*** | (2006.01) |
| ***C22C 38/06*** | (2006.01) |
| ***C22C 38/02*** | (2006.01) |
| ***C22C 38/04*** | (2006.01) |
| ***C22C 38/00*** | (2006.01) |

(52) U.S. Cl.
CPC ..... *C21D 9/08* (2013.01); *C21D 6/004* (2013.01); *C21D 6/005* (2013.01); *C21D 6/008* (2013.01); *C21D 8/105* (2013.01); *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C21D 2211/001* (2013.01)

(58) Field of Classification Search
None
See application file for complete search history.

(56) References Cited

FOREIGN PATENT DOCUMENTS

| | | | |
|---|---|---|---|
| CN | 101448966 A | | 6/2009 |
| CN | 105002425 A | | 10/2015 |
| CN | 105586529 A | | 5/2016 |
| JP | 2009263715 A | * | 11/2009 |

OTHER PUBLICATIONS

International Search Report and Written Opinion for related PCT App No. PCT/CN2019/078163 dated Jun. 12, 2019, 10 pgs.

* cited by examiner

*Primary Examiner* — Anthony M Liang
(74) *Attorney, Agent, or Firm* — Procopio, Cory, Hargreaves & Savitch LLP

(57) ABSTRACT

The present disclosure provides a low temperature resistant oil casing having high strength and high toughness, and the manufacturing method thereof, the chemical composition of the oil casing by mass of: C: 0.08-0.14%, Si: 0.1-0.4%, Mn: 0.6-1.3%, Cr: 0.5-1.5%, Mo: 0.2-0.5%, Ni: 0.2-0.5%, Nb: 0.02-0.05%, V: 0-0.1%, Al: 0.01-0.05%, Ca: 0.0005-0.005%, and the balance being Fe and unavoidable impurities. The method of manufacturing the oil casing includes: (1) smelting and continuous casting; (2) perforating and continuous rolling; (3) heat treatment, wherein an austenitizing temperature is controlled in the range of 900-930° C., and held for 30-60 min, followed by quenching, subsequently, tempering at temperature of 480-600° C., holding the temperature for 50-80 min; (4) hot sizing.

12 Claims, 1 Drawing Sheet

LOW TEMPERATURE RESISTANT OIL CASING HAVING HIGH STRENGTH AND HIGH TOUGHNESS, AND MANUFACTURING METHOD THEREOF

CROSS-REFERENCE TO RELATED APPLICATIONS

This application is a U.S. National Stage entry of PCT Application No: PCT/CN2019/078163 filed Mar. 14, 2019, which claims priority to Chinese Patent Application No. 201810234656.8 filed Mar. 21, 2018, the contents of which are incorporated herein by reference.

FIELD OF THE DISCLOSURE

The present disclosure relates to an oil casing and manufacturing method thereof, and specifically to a low temperature resistant oil casing having high strength and high toughness and manufacturing method thereof.

BACKGROUND OF ART

For high-grade steel casings used in particularly low-temperature environment, cracks emerge and expand along the longitudinal direction of the casing. In order to ensure the use safety of the casing in the low temperature environment, the longitudinal impact toughness of the casing is to be improved at low temperature, the tendency of the casing to crack longitudinally under low temperature is to be reduced while keeping high mechanical strength and transverse impact toughness, and low ductile-brittle transition temperature of the casing.

In the prior art, Chinese publication CN 101629476A with publication date of Jan. 20, 2010 and a title of "High-strength and high-toughness oil casing with low temperature resistance of −40~−80° C." discloses a high-strength and high-toughness oil casing that is resistant to a temperature low as −40~−80° C., comprising C of 0.16-0.35%, and combined with elements Cr, Mo, Ni and micro-alloying elements as V and Nb. The casing has a yield strength of 1034~1172 MPa at normal temperature; a ductile-brittle transition temperature of −40° C.~−80° C.; a Charpy V-type transverse impact energy of 50-80 J and a longitudinal impact energy of 80-120 J at ductile-brittle transition temperature; and an average grain size of 8.5~10 grade. However, since it is a medium-carbon system, the case has a high ductile-brittle transition temperature and is low in toughness at this temperature.

Chinese publication CN103160752A, publicated Jun. 19, 2013, titled as "High-strength seamless steel pipe with excellent low-temperature toughness and manufacturing method thereof" discloses a high-strength seamless steel pipe with excellent low-temperature toughness and manufacturing method thereof. Its strength grade is up to 125 Ksi, but the content of element Ni in its composition is high and its cost is high.

In view of the above, it is expected to obtain a low temperature resistant oil casing having high strength and high toughness, having good low temperature toughness, low ductile-brittle transition temperature, and high mechanical strength, so as to meet the requirements of low temperature resistance, high strength and high toughness of oil casing during low temperature oilfield exploitation.

SUMMARY

One of the objects of the present disclosure is to provide a low temperature resistant oil casing having high strength and high toughness, having good low temperature toughness, low ductile-brittle transition temperature, and high mechanical strength, so as to meet the requirements of low temperature resistance, high strength and high toughness of oil casing during low temperature oilfield exploitation.

In order to achieve the above object, the present disclosure discloses a low temperature resistant oil casing having high strength and high toughness, the chemical composition by mass of: C: 0.08-0.14%, Si: 0.1-0.4%, Mn: 0.6-1.3%, Cr: 1-1.4%, Mo: 0.2-0.5%, Ni: 0.2-0.5%, Nb: 0.02-0.05%, V: 0-0.1%, Al: 0.01-0.05%, Ca: 0.0005-0.005%, the balance being Fe and unavoidable impurities.

The composition design principle for the low temperature resistant oil casing having high strength and high toughness according to the present disclosure is as follows:

C: C is a carbide forming element, which can improve the strength of steel. If the content is less than 0.08%, the hardenability is decreased, and the strength and toughness of the steel are decreased. If the content is more than 0.14%, the segregation of the steel will deteriorate, the carbide is coarsened, and the lattice distortion stress is increased, so that the low temperature toughness of the steel is remarkably lowered, and it is difficult to achieve the requirements of high strength and high toughness at low temperature. Therefore, the inventors of the present disclosure limit the C content in the low temperature resistant oil casing having high strength and high toughness to 0.08-0.14%.

Si: The solid solution of Si in ferrite can improve the yield strength of the steel. However, the Si content should not be too high, too high silicon content will thicken the surface oxide skin of the steel, affect the cooling effect, resulting in deterioration of steel processing and toughness. When the Si content is less than 0.1%, the effect of the deoxidizer is lowered. Therefore, the inventors of the present disclosure limit the Si content in the low temperature resistant oil casing having high strength and high toughness to 0.1-0.4%.

Mn: Mn is an austenite-forming element, which can improve the hardenability of steel. In the steel system of the present disclosure, if the content is less than 0.6%, the hardenability of the steel is significantly lowered, the proportion of martensite is lowered, and thereby the toughness is lowered. If the content is more than 1.3%, the composition segregation in the steel is remarkably increased, and the uniformity and impact property of the hot-rolled microstructure are affected. Therefore, the inventors of the present disclosure limit the Mn content in the low temperature resistant oil casing having high strength and high toughness to 0.6-1.3%.

Mo: Mo mainly improves the strength and tempering stability of steel by carbides and solid solution strengthening. In the steel system of the present disclosure, due to the low carbon content, if the Mo content is higher than 0.5%, it is hard for Mo to form more carbide precipitation phase, resulting in a waste of the alloy, and when the Mo content is less than 0.2%, the strength of the steel cannot reach the requirement of high strength. Therefore, the inventors of the present disclosure limit the Mo content in the low temperature resistant oil casing having high strength and high toughness to 0.2-0.5%.

Cr: Cr is an element that strongly enhances the hardenability of steel, and is also a strong carbide-forming element, which can precipitate carbides during tempering to increase the strength of steel, but if the content is more than 1.4%, coarse $M_{23}C_6$ carbides tend to be precipitated at grain boundary and martensitic lath bundle boundary to reduce toughness. If the content is less than 1%, it is hard to ensure the hardenability. Therefore, the inventors of the present disclosure limit the Cr content in the low temperature resistant oil casing having high strength and high toughness to 1-1.4%.

Ni: Ni is an austenite-forming element, which can enlarge the austenite phase region, increase the stability of supercooled austenite, improve the hardenability of steel, and increase the proportion of residual austenite after quenching. Because of the good plasticity and unique distribution of residual austenite, the low temperature impact toughness of steel can be improved. If the Ni content is less than 0.2%, the low temperature impact toughness is not improved obviously. If the Ni content is more than 0.5%, the low temperature impact toughness will no longer change, but the strength of the steel is reduced, and the cost is increased. Therefore, the inventors of the present disclosure limit the Ni content in the low temperature resistant oil casing having high strength and high toughness to 0.2-0.5%.

V: V element can refine grains in steel, and the carbides formed by it can greatly improve the strength of steel through precipitation strengthening. However, when the addition amount of V is increased to a certain level, its further reinforcing effect is not obvious, and V is a relatively expensive alloying element. Therefore, the inventors of the present disclosure limit the V content in the low temperature resistant oil casing having high strength and high toughness to 0-0.1%.

Nb: Nb is an element for grain refinement and precipitation strengthening, which can compensate for the decrease of strength caused by the decrease of carbon content. When the content is less than 0.02%, the effect is not obvious. When the content is more than 0.05%, coarse Nb (CN) is likely to formed, thereby reducing toughness. In addition, Nb is a relatively expensive alloying element, and therefore, the inventors of the present disclosure limit the Nb content in the low temperature resistant oil casing having high strength and high toughness to 0.02-0.05%.

Ca: Ca can purify molten steel, promote the spheroidization of MnS, and improve impact toughness. However, if the content is too high, it is easy to form coarse non-metallic inclusions. Therefore, the inventors of the present disclosure limit the Ca content in the low temperature resistant oil casing having high strength and high toughness to 0.0005-0.005%.

Al: Al is a good deoxidizing element, but adding too much is easy to cause alumina inclusions. Therefore, it is necessary to increase the proportion of acid-soluble aluminum in total aluminum, and feed an appropriate amount of Al wire after vacuum degassing. Therefore, the inventors of the present disclosure limit the Al content in the low temperature resistant oil casing having high strength and high toughness to 0.01-0.05%.

It should be noted that in the technical solution of the present disclosure, the unavoidable impurities are mainly P and S. P and S are harmful impurity elements in steel. If the P content is too high, it will segregate grain boundary, embrittle grain boundary, and seriously deteriorate the toughness of steel. If the S content is too high, the content of inclusions in steel will increase, which is unfavorable to the low temperature toughness of steel. Therefore, the P and S contents in the steel should be minimized. Preferably, the P and S contents in the low temperature resistant oil casing having high strength and high toughness are limited to $P \leq 0.01$ and $S \leq 0.003$.

Further, the low temperature resistant oil casing having high strength and high strength according to the present disclosure further satisfies the formula: $0.3 < Mn/(Cr+Mn) \leq 0.5$, wherein Mn and Cr respectively represent the mass percent of the corresponding element.

In the above technical solution, segregation is improved by limiting the content of Mn and Cr to satisfy the formula: $0.3 < Mn/(Cr+Mn) \leq 0.5$, thereby ensuring good low temperature toughness of the low temperature resistant oil casing having high strength and high toughness in the present disclosure.

Further, the low temperature resistant oil casing having high strength and high toughness of the present disclosure has a microstructure of fine and uniform tempered sorbite and residual austenite.

In the technical solution of the present disclosure, the microstructure of the low temperature resistant oil casing having high strength and high toughness is a fine and uniform tempered sorbite structure and residual austenite, and the fine and uniform tempered sorbite structure can ensure the low temperature resistant oil casing having high strength and high toughness has a good combination of strength and toughness. The residual austenite can ensure the low temperature resistant oil casing having high strength and high toughness has a good plastic toughness, which can improve the impact toughness of the low temperature resistant oil casing having high strength and high toughness at low temperature.

Further, in the low temperature resistant oil casing having high strength and high toughness according to the present disclosure, the ratio of the residual austenite is 3% to 6%.

Further, the low temperature resistant oil casing having high strength and high toughness according to the present disclosure has a grain size of 10 or more.

Further, the low temperature resistant oil casing having high strength and high toughness according to the present disclosure has carbide particles that are finely dispersed and distributed at the grain boundary and within the grains.

Further, The low temperature resistant oil casing having high strength and high toughness according to the present disclosure has a yield strength ≥965 MPa, a tensile strength ≥1034 MPa, a ductile-brittle transition temperature in the range of −60° C.~−100° C., a transverse impact energy under −60° C.≥100 J, a longitudinal impact energy ≥120 J, and a fracture shear ratio ≥75%.

Accordingly, another object of the present disclosure is to provide a method for manufacturing the low temperature resistant oil casing having high strength and high toughness, which is simple in process, low in production cost, through reasonable composition design and optimized process parameters, the low temperature resistant oil casing having high strength and high toughness has better low temperature toughness, lower ductile-brittle transition temperature, and high mechanical strength.

In order to achieve the above object, the present disclosure provides a method of manufacturing a low temperature resistant oil casing having high strength and high toughness, comprising steps of:

(1) smelting and continuous casting;

(2) perforating and continuous rolling;

(3) heat treatment, wherein an austenitizing temperature is controlled in the range of 900-930° C., and held for 30-60 minutes, followed by quenching, subsequently, tempering at temperature of 480-600° C., holding the temperature for 50-80 minutes;

(4) hot sizing.

Further, in the manufacturing method of the present disclosure, in step (1), a superheat of molten steel in the casting process is controlled to be ≤30° C., and the continuous casting speed is controlled to be 1.8-2.2 m/min.

In the manufacturing method of the present disclosure, in some embodiments, steel scrap and hot metal of blast furnace can be used for batching, the proportion of hot metal may be 50-60%, the molten steel is smelted in the electric furnace, secondary refined, degassed under vacuum and stirred by argon, then subjected to Ca treatment for inclusions modification to reduce the contents of O and H. Then casting the alloy into a round billet, during the casting process, the superheat of the molten steel is controlled to be ≤30° C., electromagnetic stirring is adopted, and the continuous casting speed is controlled to be 1.8-2.2 m/min to reduce composition segregation.

Further, in the manufacturing method of the present disclosure, in step (2), a round billet is soaked at a temperature of 1200-1240° C., and then is perforated at the temperature of 1180-1240° C., a finishing rolling temperature of continuous rolling is controlled at 900° C.-950° C., and a sizing temperature is controlled at 850° C.-900° C.

In the manufacturing method of the present disclosure, in some embodiments, after cooling the continuous casting round billet, it is heated in an annular heating furnace, and the continuous casting round billet is soaked at a temperature of 1200-1240° C. and then is perforated.

Further, in the manufacturing method of the present disclosure, in step (4), the hot sizing temperature is 400-550° C.

Compared with the prior art, the low temperature resistant oil casing having high strength and high toughness and the manufacturing method thereof according to the present disclosure have the following beneficial effects:

(1) The disclosure adopts a low-C system, and the C content is lower than that of the conventional steel. segregation is improved by limiting the content of Mn and Cr to satisfy the formula: $0.3<Mn/(Cr+Mn)\leq 0.5$, and a certain amount of Ni element is added in combination, thereby ensuring that the low temperature resistant oil casing having high strength and high toughness has better low temperature toughness, lower ductile-brittle transition temperature, and high mechanical strength.

(2) The method for manufacturing the low temperature resistant oil casing having high strength and high toughness of the present disclosure is simple in process, low in production cost, and easy to be mass-produced.

DESCRIPTION OF THE EMBODIMENTS

Figure 1:
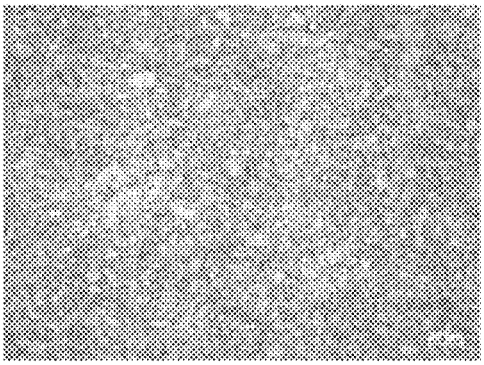
FIG. 1 is a metallographic diagram of a low temperature resistant oil casing having high strength and high toughness according to Example 3 of the present disclosure.

The low temperature resistant oil casing having high strength and high toughness and manufacturing method thereof will be further explained and illustrated with reference to the accompanying drawings and specific examples. However, the present technical solution is not limited to these explanation and illustration.

Examples 1-5 and Comparative Examples 1-5

Table 1-1 and Table 1-2 list the mass percentage of the various chemical elements of each low temperature resistant oil casing having high strength and high toughness in Examples 1-5 and Comparative Examples 1-5.

TABLE 1-1

(wt. %, The balance is Fe and other unavoidable impurities other than P and S)

| Serial number | C | Mn | Si | P | S | Cr | Mn/(Mn + Cr) |
|---|---|---|---|---|---|---|---|
| Example 1 | 0.08 | 0.6 | 0.2 | 0.009 | 0.002 | 1.2 | 0.33 |
| Example 2 | 0.09 | 0.8 | 0.1 | 0.010 | 0.001 | 1 | 0.44 |
| Example 3 | 0.1 | 1 | 0.3 | 0.010 | 0.003 | 1.4 | 0.42 |
| Example 4 | 0.12 | 1.1 | 0.4 | 0.012 | 0.002 | 1.4 | 0.44 |
| Example 5 | 0.14 | 1.2 | 0.25 | 0.013 | 0.002 | 1.3 | 0.48 |
| Comparative Example 1 | 0.12 | 1.6 | 0.26 | 0.007 | 0.003 | 0.3 | 0.84 |
| Comparative Example 2 | 0.12 | 1.2 | 0.33 | 0.008 | 0.003 | 1.3 | 0.48 |
| Comparative Example 3 | 0.26 | 0.9 | 0.2 | 0.010 | 0.001 | 1.2 | 0.43 |
| Comparative Example 4 | 0.14 | 1.2 | 0.3 | 0.010 | 0.003 | 1.2 | 0.50 |
| Comparative Example 5 | 0.12 | 1.1 | 0.3 | 0.008 | 0.003 | 1.3 | 0.46 |

TABLE 1-2

(wt. %, The balance is Fe and other unavoidable impurities other than P and S)

| Serial number | Mo | V | Nb | Al | Ca | Ni |
|---|---|---|---|---|---|---|
| Example 1 | 0.2 | 0.05 | 0.03 | 0.01 | 0.0005 | 0.3 |
| Example 2 | 0.3 | 0.03 | 0.02 | 0.04 | 0.001 | 0.4 |
| Example 3 | 0.4 | 0.05 | 0.03 | 0.05 | 0.005 | 0.3 |
| Example 4 | 0.5 | 0.07 | 0.03 | 0.03 | 0.003 | 0.2 |
| Example 5 | 0.4 | 0.1 | 0.04 | 0.02 | 0.002 | 0.4 |
| Comparative Example 1 | 0.2 | 0.05 | 0.03 | 0.023 | 0.002 | 0.5 |
| Comparative Example 2 | 0.3 | 0.03 | 0.03 | 0.03 | 0.002 | 0 |
| Comparative Example 3 | 0.2 | 0.05 | 0.02 | 0.04 | 0.001 | 0.3 |
| Comparative Example 4 | 0.6 | 0.06 | 0.04 | 0.05 | 0.003 | 0.2 |
| Comparative Example 5 | 0.3 | 0 | 0 | 0.03 | 0.002 | 0.3 |

The low temperature resistant oil casing having high strength and high toughness in Examples 1-5 and Comparative Examples 1-5 are prepared according to the following steps:

(1) smelting and continuous casting: steel scrap and hot metal of blast furnace are used for batching, the proportion of hot metal is 50-60%, the molten steel is smelted in the electric furnace, secondary refined, degassed under vacuum and stirred by argon, then subjected to Ca treatment for inclusions modification to reduce the contents of O and H. Then casting the alloy into a round billet, during the casting process, the superheat of the molten steel is controlled to be ≤30° C., electromagnetic stirring is adopted, and the continuous casting speed is controlled to be 1.8-2.2 m/min to reduce composition segregation.

(2) perforating and continuous rolling: after cooling the continuous casting round billet, it is heated in an annular heating furnace, and the continuous casting round billet is soaked at a temperature of 1200-1240° C. and then is perforated. the perforation temperature is controlled at 1180-1240° C., a finishing rolling temperature of continuous rolling is controlled at 900° C. -950° C., and a sizing temperature is controlled at 850° C.-900° C.

(3) heat treatment, wherein an austenitizing temperature is controlled in the range of 900-930° C., and held for 30-60 minutes, followed by quenching, subsequently, tempering at temperature of 480-600° C., holding the temperature for 50-80 minutes;

(4) hot sizing: the hot sizing temperature is controlled in the range of 400-550° C.

Table 2-1 and Table 2-2 list the specific process parameters of the method for manufacturing the low temperature resistant oil casing having high strength and high toughness of Examples 1-5 and Comparative Examples 1-5.

The low temperature resistant oil casings having high strength and high toughness of Examples 1-5 and Comparative Examples 1-5 were sampled, and various mechanical properties were tested. The yield strength, tensile strength and elongation were measured by GB/T 228.1-2010 Metallic Materials-Tensile Testing-Part 1: Method of tensile testing at ambient temperature. GB/T 229-2007 Metallic Materials: Charpy pendulum impact test method, was used to test the low temperature impact toughness and shear ratio, the ductile-brittle transition temperature is the corresponding temperature when the shear ratio is 50%. The relevant mechanical properties measured by the test are listed in Table 3. Among them, the fracture shear ratio refers to the area of fibrous region/total fracture area.

TABLE 2-1

| | Step(1) | | Step(2) | | | |
|---|---|---|---|---|---|---|
| | | | | | Finishing | |
| Serial number | Superheat (° C.) | Continuous casting speed (m/min) | Soaking temperature (° C.) | Perforation temperature (° C.) | rolling temperature (° C.) | Sizing temperature (° C.) |
| Example 1 | 25 | 2 | 1220 | 1180 | 910 | 850 |
| Example 2 | 10 | 2.2 | 1230 | 1210 | 900 | 860 |
| Example 3 | 20 | 2.1 | 1240 | 1220 | 940 | 870 |
| Example 4 | 30 | 1.8 | 1230 | 1190 | 950 | 880 |
| Example 5 | 25 | 1.8 | 1200 | 1240 | 920 | 890 |
| Comparative Example 1 | 20 | 1.9 | 1230 | 1210 | 920 | 900 |
| Comparative Example 2 | 15 | 2.2 | 1240 | 1220 | 940 | 880 |
| Comparative Example 3 | 20 | 1.9 | 1210 | 1230 | 950 | 870 |
| Comparative Example 4 | 20 | 1.9 | 1220 | 1240 | 920 | 890 |
| Comparative Example 5 | 20 | 1.9 | 1210 | 1230 | 950 | 870 |

TABLE 2-2

| | Step(3) | | | | |
|---|---|---|---|---|---|
| Serial number | Austenitizing temperature (° C.) | Holding time (min) | Tempering temperature (° C.) | Tempering holding time (min) | Step(4) Hot sizing temperature (° C.) |
| Example 1 | 900 | 50 | 480 | 50 | 480 |
| Example 2 | 930 | 30 | 500 | 60 | 500 |
| Example 3 | 910 | 60 | 550 | 60 | 530 |
| Example 4 | 920 | 60 | 580 | 80 | 550 |
| Example 5 | 900 | 40 | 550 | 70 | 530 |
| Comparative Example 1 | 900 | 40 | 550 | 70 | 530 |
| Comparative Example 2 | 930 | 60 | 550 | 60 | 530 |
| Comparative Example 3 | 910 | 40 | 550 | 60 | 530 |
| Comparative Example 4 | 910 | 40 | 550 | 60 | 530 |
| Comparative Example 5 | 910 | 40 | 550 | 60 | 530 |

TABLE 3

| Serial number | Yield strength (Mpa) | Tensile strength (Mpa) | Elongation (%) | Ductile-brittle transition temperature (° C.) | transverse impact energy under −60° C. (J) | longitudinal impact energy under −60° C. (J) | Shear ratio (%) |
|---|---|---|---|---|---|---|---|
| Example 1 | 1050 | 1090 | 25 | −80 | 108 | 128 | 75 |
| Example 2 | 1070 | 1110 | 24 | −75 | 103 | 122 | 75 |
| Example 3 | 1090 | 1140 | 26 | −70 | 115 | 125 | 75 |
| Example 4 | 1120 | 1160 | 22 | −80 | 121 | 133 | 80 |
| Example 5 | 1100 | 1150 | 23 | −80 | 137 | 132 | 80 |
| Comparative Example 1 | 1100 | 1150 | 23 | −50 | 60 | 120 | 30 |
| Comparative Example 2 | 1120 | 1170 | 24 | −25 | 51 | 70 | 10 |
| Comparative Example 3 | 1100 | 1360 | 25 | −25 | 42 | 60 | 10 |
| Comparative Example 4 | 1150 | 1290 | 22 | −30 | 45 | 60 | 15 |
| Comparative Example 5 | 1030 | 1070 | 21 | −30 | 45 | 55 | 15 |

As seen from Table 3, the low temperature resistant oil casings having high strength and high toughness of Examples 1-5 have a yield strength ≥965 MPa, a tensile strength ≥1034 MPa, a ductile-brittle transition temperature of −60° C.~−80° C., a transverse impact energy under −60° C.≥100 J, a longitudinal impact energy ≥120 J, and a fracture shear ratio ≥75%.

In Comparative Example 1, the Cr content is low, the Mn content is high, and Mn/(Mn+Cr)>0.5, resulting in severe segregation in the structure, and coarse carbides in the segregation. Although the strength can be maintained, the ductile-brittle transition temperature is significantly increased. The impact toughness under −60° C. is drastically reduced.

No Ni is added in Comparative Example 2, resulting in low hardenability, and the content of residual austenite decrease after heat treatment. Although the effect on strength is small, the ductile-brittle transition temperature increases significantly, the impact toughness under −60° C. decreased sharply, and the shear ratio decreased.

The C content of Comparative Example 3 is too high, resulting in severe segregation after heat treatment, a marked increase in ductile-brittle transition temperature, a sharp decrease in impact toughness under −60° C., and a decrease in shear ratio.

As seen from FIG. 1, the low temperature resistant oil casing having high strength and high toughness of Example 3 has a fine and uniform tempered sorbite structure.

Figure 2:
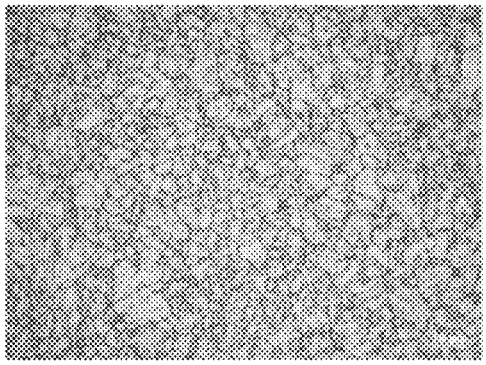
FIG. 2 is a grain diagram of a low temperature resistant oil casing having high strength and high toughness according to Example 3 of the present disclosure.

As seen from FIG. 2, its grain size is finer than that of the conventional oil casing, and the grain size is above 10 (the grain size is tested by the ASTM E112-2013 Standard Test Methods for Determining Average Grain Size). There is 3-6% residual austenite.

Figure 3:
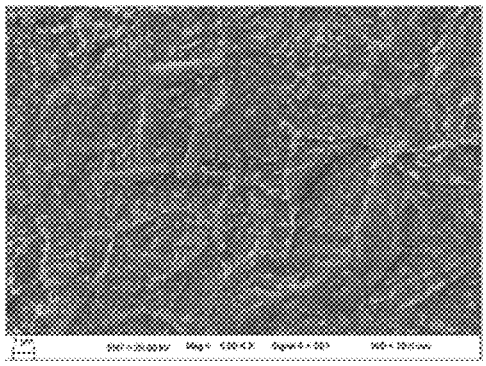
FIG. 3 is a view showing the distribution of carbide particles of the low temperature resistant oil casing having high strength and high toughness according to Example 3 of the present disclosure.

As seen from FIG. 3, the low temperature resistant oil casing having high strength and high toughness of Example 3 has carbide particles that are finely dispersed and distributed at the grain boundary and within the grains.

It should be noted that the prior art in the scope of protection of the present disclosure is not limited to the embodiments given in the present application, and all prior art that does not contradict the solution of the present disclosure, including but not limited to prior Patent documents, prior publications, prior disclosure, prior public use etc., can be included in the scope of protection of the present disclosure.

In addition, the combination of the technical features in the present disclosure is not limited to the combination described in the claims of the present disclosure or the combination described in the specific embodiments, and all the technical features described in the present disclosure can be freely combined or assembled in any way, unless there is a contradiction between them.

It must be noted that the above embodiments are merely specific embodiments of the present disclosure, and it is obvious that the present disclosure is not limited to the above embodiments, and similar variations or modifications which are directly derived from or can be easily associated with the disclosure of the present disclosure by person skilled in the art shall fall into the protection scope of the present disclosure.

The invention claimed is:

1. An oil casing having a chemical composition by mass of:

C: 0.08-0.14%;
Si: 0.1-0.4%;
Mn: 0.6-1.3%;
Cr: 1-1.4%;
Mo: 0.2-0.5%;
Ni: 0.2-0.5%;
Nb: 0.02-0.05%;
V: 0-0.1%;
Al: 0.01-0.05%; and
Ca: 0.0005-0.005%,
balance being Fe and unavoidable impurities,
wherein the oil casing has a tensile strength of at least 1,034 MPa.

2. The oil casing according to claim 1, which further satisfies formula:

$0.3<Mn/(Cr+Mn)\leq 0.5$, wherein Mn and Cr respectively represent a mass percent of a corresponding element.

3. The oil casing according to claim 1, wherein the oil casing has a microstructure of fine and uniform tempered sorbite and residual austenite.

4. The oil casing according to claim 3, wherein a ratio of the residual austenite is 3% to 6%.

5. The oil casing according to claim 3, wherein the oil casing has a grain size of 10 or more.

6. The oil casing according to claim 3, wherein the oil casing has carbide particles that are finely dispersed and distributed at a grain boundary and within grains.

7. The oil casing according to claim 1, wherein the oil casing has a yield strength ≥965 MPa, a ductile-brittle transition temperature in a range of −60° C to −100° C., a transverse impact energy under −60° C. ≥100J, a longitudinal impact energy ≥120 J, and a fracture shear ratio ≥75%.

8. An oil casing having a chemical composition by mass of:

C: 0.08-0.14%;
Si: 0.1-0.4%;
Mn: 0.6-1.3%;
Cr: 1-1.4%;
Mo: 0.2-0.5%;
Ni: 0.2-0.5%;
Nb: 0.02-0.05%;
V: 0-0.1%;
Al: 0.01-0.05%; and
Ca: 0.0005-0.005%,
balance being Fe and unavoidable impurities,
wherein the oil casing has a microstructure of fine and uniform tempered sorbite and residual austenite.

9. The oil casing having according to claim 1, wherein the oil casing has a yield strength ≥965 MPa.

10. The oil casing having according to claim 9, wherein the oil casing has a ductile-brittle transition temperature in a range of −60° C. to −100° C.

11. The oil casing having according to claim 10, wherein the oil casing has a transverse impact energy under −60° C. ≥100 J.

12. The oil casing having according to claim 11, wherein the oil casing has a longitudinal impact energy ≥120 J.

* * * * *